United States Patent [19]

Bullock

[11] Patent Number: 4,707,960

[45] Date of Patent: Nov. 24, 1987

[54] CEILING INSULATION AND METHOD OF INSTALLATION

[76] Inventor: Christopher A. Bullock, 3321 Pines Rd., Shreveport, La. 71119

[21] Appl. No.: 577,525

[22] Filed: Feb. 6, 1984

[51] Int. Cl.[4] ..... E04B 1/74

[52] U.S. Cl. ..... 52/404; 52/90; 52/22

[58] Field of Search ..... 52/404, 405, 406, 483, 52/743, 748, 90, 393, 407, 416, 746, 807, 309.8, 22, 95

[56] References Cited

U.S. PATENT DOCUMENTS

| | | | |
|---|---|---|---|
| 3,722,171 | 3/1973 | Godley | 52/90 X |
| 4,384,437 | 5/1983 | Coles | 52/404 |

FOREIGN PATENT DOCUMENTS

| | | | |
|---|---|---|---|
| 2700468 | 6/1978 | Fed. Rep. of Germany | 52/406 |
| 2460371 | 2/1981 | France | 52/404 |
| 8201024 | 4/1982 | Int'l Pat. Institute | 52/404 |

OTHER PUBLICATIONS

"Insulation, Building, Mineral-Wool; Batts, Loose-Fill, and Granular Fill", Federal Standard Stock Catalog, Section IV, Part 5, No. HH-I-521c, 1937.

*Primary Examiner*—Carl D. Friedman

*Attorney, Agent, or Firm*—John M. Harrison

[57] ABSTRACT

A ceiling insulation structure for an attic which includes a "sheetrock" or "dry wall" ceiling carried by attic ceiling joists in spaced relationship, insulating material provided between the ceiling joists and covering the sheetrock and a water vapor-permeable film or membrane of selected thickness covering the insulating material and the ceiling joists to prevent air from circulating through the insulating material and reducing the efficiency of the insulating material. A method for increasing the efficiency of insulating material in an attic which includes covering the insulating material and the ceiling joists with a water vapor-permeable film or membrane of selected thickness.

13 Claims, 2 Drawing Figures

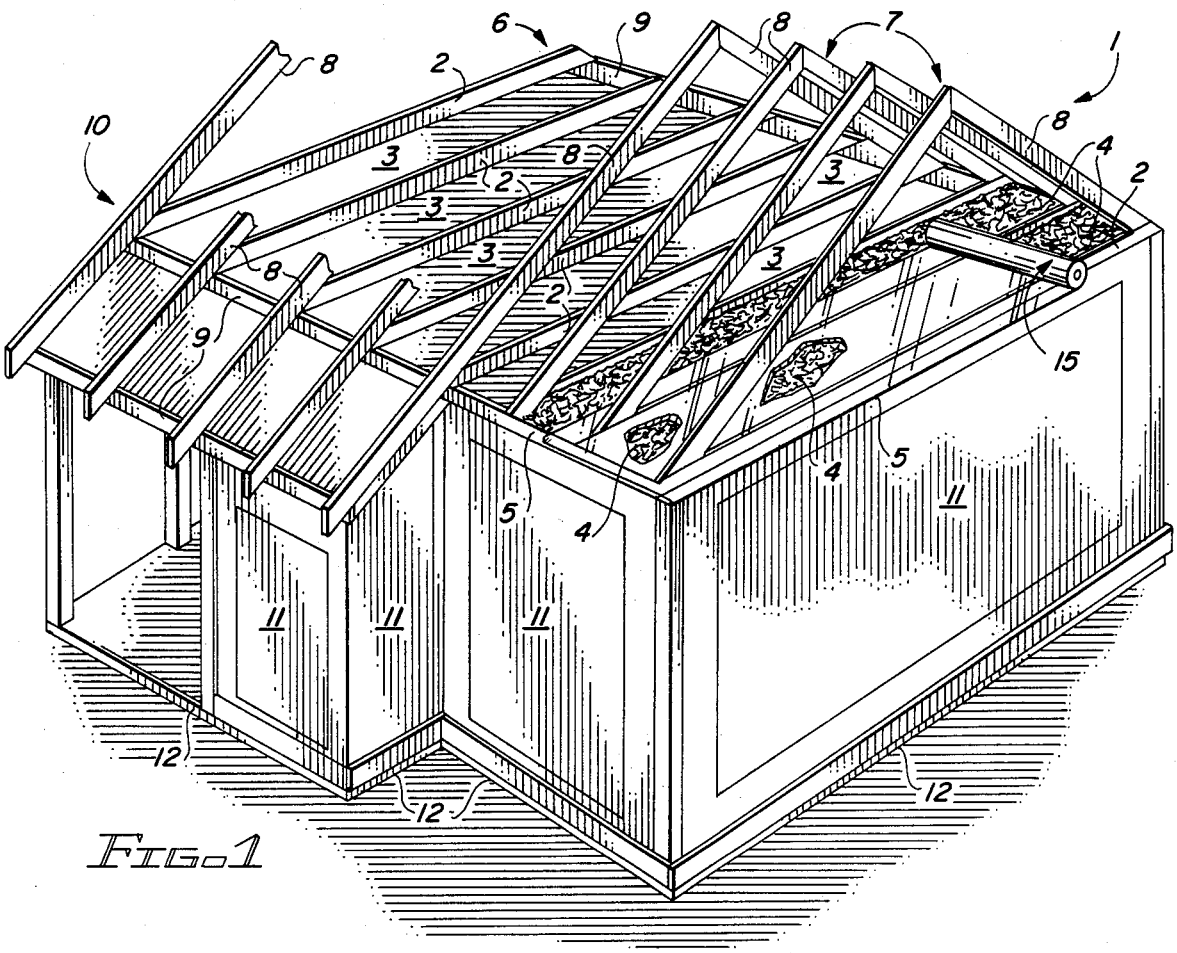
FIG. 1
FIG. 2
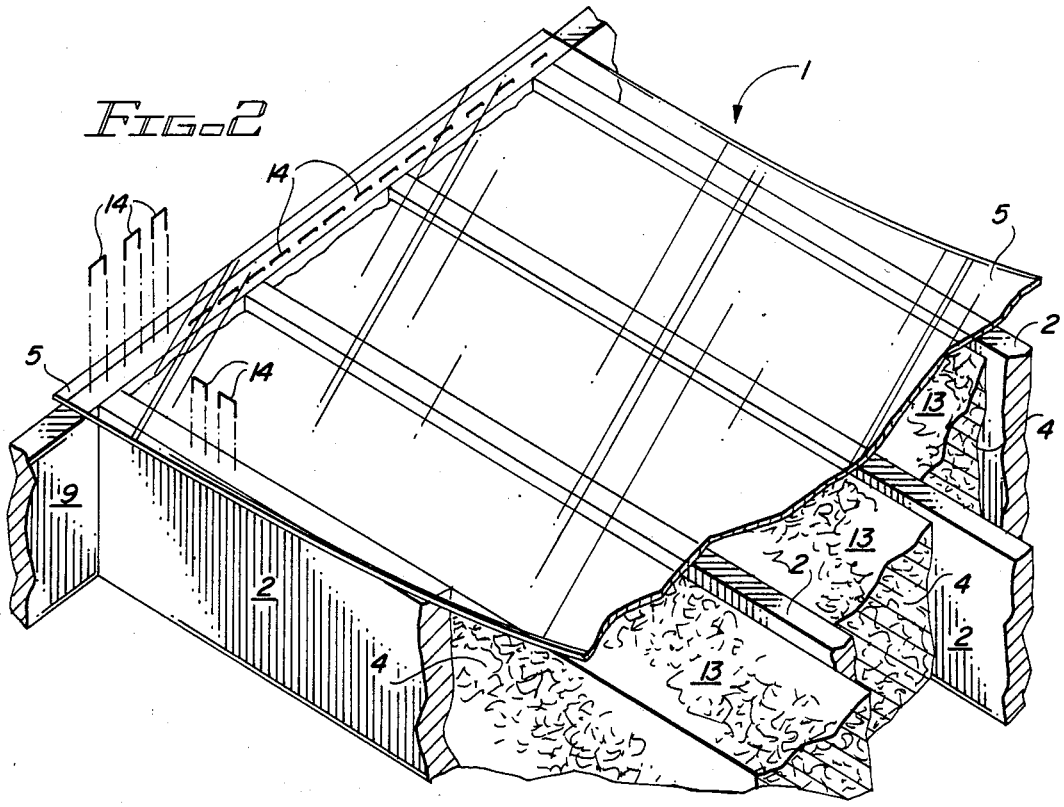

CEILING INSULATION AND METHOD OF INSTALLATION

BACKGROUND OF THE INVENTION

FIELD OF THE INVENTION

This invention relates to the insulation of structures and more particularly, to a ceiling insulation structure for attics which incorporates a water vapor-permeable film or membrane installed over ceiling joists supporting a ceiling structure and covering insulation disposed between the ceiling joists, which film substantially prevents the circulation of air through the insulation in the attic. The invention further relates to a method for installing the film in the ceiling insulation structure in order to better increase the efficiency of the insulation.

The ceiling insulation structure improvement and method of this invention is characterized in one embodiment by a relatively thin, moisture-permeable film or membrane situated over insulation, which insulation is supported by the ceiling structure between the ceiling joists of an attic, in order to substantially prevent air from circulating through the insulation to reduce the efficiency of the insulation. Such ceiling structures are typically characterized by a "dry wall" or "sheetrock" material which serves to partition the living area of a structure from the attic. In a preferred embodiment of the invention a 2 mil polyethylene membrane or film is placed over insulation material provided in the form of batts or particulate, blown insulation placed on the ceiling sheet rock and between the ceiling joists of an attic in order to isolate the insulation from air which normally circulates through the attic. In a most preferred embodiment of the invention the membrane is secured at the outer perimeter of the attic near the point where the roof line meets the ceiling joists and is maintained in unsealed, but lapped condition as it crosses the center portion of the attic. In this manner, air which circulates through the attic is not permitted to enter the insulation to provide a conduit for heat movement from the attic of the structure to the interior thereof and from the interior into the attic, as the case may be.

Conventional insulating techniques have taken the form of placing batts or blown, loose-fill insulation between the ceiling joists of an attic in a structure in order to provide a medium which contains air pockets designed to minimize the passage of heat from the attic into the interior of the structure and from the interior back into the attic. The efficiency of such insulation is commonly measured in terms of an "R" factor, which depends upon the character and thickness of the insulation. Conventional insulation installation frequently includes the use of a "vapor barrier" sheeting positioned between the insulation and the dry wall or sheetrock or alternative ceiling covering which separates the rooms of the structure from the attic itself and serves both as a support for the insulation and also as an insulating component. The insulation material such as fiberglass or other material capable of trapping air is placed on the sheetrock and between the ceiling joists in the form of batts, rolled strips or in particulate form, by way of blowing, and the structure is considered to be well insulated, depending upon the thickness and character of the insulation installed. It has surprisingly been found that the insulation installed in this manner has little effect upon the heat loss and gain of a structure through the attic area under a variety of weather conditions and temperatures. Experimentation has shown that use of a "vapor barrier" installed in the manner described above does little to aid the insulation process, since air circulation in the attic destroys much of the efficiency of the insulation and in many cases, the sheetrock ceiling itself is the only effective insulating barrier between the interior of the structure and the attic. It has also been determined that the use of a membrane of selected thickness and character installed on top of the insulation and ceiling joists of an attic does not, as widely believed, trap and retain excessive quantities of moisture between the membrane and the insulation and degrade the sheetrock. In contrast, it has been found that the moisture is able to readily move through the insulation and through certain moisture-permeable films and membranes and escape into the attic itself, where the moisture is removed by ventilators, with no adverse effect on either the insulation or the underlying sheetrock. The addition of such a moisture-permeable membrane or film has been found to reduce heating and cooling costs by as much as 59% and represents a significant increase in the efficiency of the underlying insulation. Since it has been estimated that 80% to 90% of the heat gain or loss in a ceiling structure having an attic takes place through the attic, the ceiling insulation structure and method of this invention becomes extremely significant in energy conservation efforts.

Many efforts have been made in recent years to improve the insulating efficiency in structures and typical of these efforts is the "Building Insulation and Method of Installation" disclosed in U.S. Pat. No. 4,155,208, to John A. Shanabarger. The insulation and method of this invention includes use of a sheet of heavy plastic and cooperating elongated plastic bags which fit between the studs of a wall structure and conform to the insulating spaces between the studs to insulate the walls. The bags are resilient and can be expanded volumetrically to substantially fully occupy the spaces between the studs and can be attached to the studs by means of stapling, or by other techniques. U.S. Pat. No. 3,298,150, to D.E. Ahlquist, discloses "Wall Insulation Structures and Method of Using Same", and describes insulation for walls and other surfaces which are characterized by multiple blocks of insulating material contained in an envelope having side panels which are disposed along the walls to insulate the walls. Another insulating wall structure is disclosed in U.S. Pat. No. 3,641,724, to James Palmer, which structure includes an integral box construction built directly into a selected wall section and further includes interior foam materials such as various urethanes, to provide the necessary insulation. An "Insulated Roof" is disclosed in U.S. Pat. No. 4,147,003, to Robert J. Alderman, which roof includes a reel of flexible sheet material mounted on a support frame and situated over a space between adjacent roof purlins. This framework is moved along the purlins and the sheet material is progressively unrolled, formed and guided by the framework down into the space between the adjacent purlins to create a trough in the spaces between the purlins. Insulation material is placed in the trough on top of the sheet material in order to insulate the roof. Another insulated roof structure is disclosed in U.S. Pat. No. 4,047,346, also to Robert J. Alderman, which includes a reel of wire mesh and a cooperating reel of sheet material carried by a supporting framework to facilitate progressively unrolling the layers of wire mesh and sheet material for application to the spaces between the roof purlins. Insulation is then placed in the wire and sheet material trough in order to insulate the roof.

It is an object of this invention to provide in one embodiment, a new and improved ceiling insulation structure for insulating the attics of homes, offices and other structures, which improved ceiling insulation structure is characterized by a moisture-permeable film or membrane placed over a mass of insulation disposed between the ceiling joists and resting on the ceiling in the attics, which film serves to minimize air circulation through the insulation.

Another object of this invention is to provide an improvement to the existing insulation in an insulated attic having a layer of sheetrock attached to the bottom of supporting attic ceiling joists and a mass of insulation located between the ceiling joists and supported by the sheetrock, which improvement includes placing a water vapor-permeable film or membrane over the insulation and the ceiling joists in order to minimize the movement of air through the insulation and thereby improve the efficiency of the insulation.

A still further object of the invention is to provide an improved ceiling insulation structure for attics, which includes a water vapor-permeable polyethylene membrane or film of selected thickness covering a quantity of insulation installed on sheetrock between the ceiling joists of the attic, which membrane serves to substantially prevent air from circulating through the insulation and increases the efficiency of the insulation, while allowing moisture to move through the insulation without collecting therein and damaging the insulation or the underlying sheetrock.

Still another object of this invention is to provide a method for increasing the efficiency of insulation in the attics of structures, which method includes the expedient of placing a water vapor-permeable membrane or film over the insulation and the ceiling joists of the attic in order to prevent extensive circulation of air through the insulation.

A still further object of the invention is to provide a method for minimizing the circulation of air and heat through insulation in the attics of structures, which method includes installing a moisture-permeable, plastic membrane or film over the insulation and ceiling joists by securing at least the outer perimeter of the film to the ceiling joists or other structural member in order to substantially isolate the insulation between the ceiling joists.

SUMMARY OF THE INVENTION

These and other objects of the invention are provided in a ceiling insulation structure for enhancing the insulating capability of attics, which includes a water vapor-permeable, thermoplastic membrane of selected thickness positioned over the ceiling joists in the attic and covering insulation provided between the ceiling joists. A method for reducing air flow through insulation in an attic and thereby increasing the efficiency of the insulation, which includes placing a water vapor or moisture-permeable thermoplastic membrane or film of selected thickness over the insulation and the ceiling joists in the attic to substantially isolate the insulation between the ceiling joists.

BRIEF DESCRIPTION OF THE DRAWING

The invention will be better understood by reference to the accompanying drawing wherein:

FIG. 1 is a perspective view, partially in section, of a structure with the attic area open to inspection and illustrating a preferred embodiment of the ceiling insulation structure and method of this invention; and FIG. 2 is sectional view of a segment of the ceiling insulation structure illustrated in FIG. 1.

DESCRIPTION OF THE PREFERRED EMBODIMENTS

Referring initially to FIG. 1 of the drawing a structure 10 is illustrated, with walls 11, a foundation 12 and an attic 6, having roof trusses 7 carrying roof supports 8, supported by ceiling joist supports 9. As illustrated in FIGS. 1 and 2, in a preferred embodiment the ceiling insulation structure of this invention is generally illustrated by reference numeral 1 and includes ceiling joists 2, with a ceiling material 3 attached to the bottom thereof, a quantity of insulation 4 disposed between the ceiling joists 2 and resting on the ceiling material 3 and a transparent film 5, positioned over the ceiling joists 2. The insulation 4 can be applied to the ceiling material 3 and between the ceiling joists 2 by means of a blowing apparatus, in the case of particulate, loose-fill insulation such as fiberglass and the like, or by laying batts between the ceiling joists 2 or by other techniques well known to those skilled in the art. When the insulation is installed as illustrated, a roll 15 of film 5 can be placed in the attic 6 of the structure 10 and a sheet of the film 5 positioned over the insulation 4 and on top of the ceiling joists 2, as illustrated.

Referring again to FIG. 2 of the drawing in a most preferred embodiment of the invention when the roll 15 is deployed to position the film 5 on top of the ceiling joists 2 and over the insulation 4 as illustrated, staples 14 are used to secure the end of the film 5 to the ceiling joists 2 or the ceiling joist supports 9 of the structure 10 or to other structural members in the structure 10, in order to secure the film 5 in the attic 6. Furthermore, as further illustrated in FIG. 2, the insulation 14 illustrated is in the form of batts, with an insulation wrap 13 securing the insulation 4 in a sandwich configuration. It will be appreciated from a further consideration of FIG. 2 that the film 5 can be lapped as it is deployed from the roll 15 in successive sheets in order to cover the entire surface area of the ceiling joists 2 and insulation 4 to minimize the effect of air circulation in the attic and reduce heat transfer through the insulation 4.

Referring again to FIGS. 1 and 2 of the drawing, it will be appreciated that the ends of the film 5 which are adjacent to the ceiling joist supports 9 and the roof supports 8 of roof trusses 7, can be cut or split to accommodate each of the roof supports 8 at the point where the roof supports 8 join ceiling joists 2, in order to cover that portion of insulation 4 which lies at the extremities of the ceiling joists 2. In another most preferred embodiment of the invention the ends, and particularly the split areas of the film 5 are secured to ceiling joist supports 9 and optionally, to the ceiling joists 2, by means of staples 14. While the character and thickness of the film 5 is important only in the sense that it must be capable of allowing water vapor to migrate through the film layer, in a preferred embodiment, the film 5 is characterized by a thickness of from about 0.5 to about 12 mils. In a most preferred embodiment of the invention a polyethylene film 5 having a thickness of from about 1.0 to about 4 mils is most preferred for use in covering the insulation 4 and ceiling joist 2 in the attic 6. However, it will be appreciated by those skilled in the art that substantially any thermoplastic or thermoresin material such as polyethylene, polypropylene and like "plastics" which can be shaped into a relatively thin film or membrane and which allow the migration of water vapor therethrough can be used to cover the insulation 4 and ceiling joist 2 according to the teachings of this invention, to more efficiently insulate the attic 6 of the structure 10. It must be remembered that the ability of the moisture or water vapor to penetrate the film 5 is directly proportional to the thickness of the film 5 chosen.

Various benefits and advantages of the present invention are more readily understood by consideration of the following examples which are merely illustrative and are not intended to limit scope of the invention.

EXAMPLE 1

Several box frames measuring 1 foot on a side in the configuration of a cube were built and were fitted with thermometers for measuring the temperature of the interior of the boxes. Two inches of fiberglass insulation was installed in one of the frames (box 1) on all six sides. Two inches of fiberglass insulation with a polyethylene film or sheath covering the insulation and exposed to the exterior of the second box (box 2) was also provided. Two volumes of five hundred milliters of water were heated to a temperature of 125° F. and one volume was placed in each of two containers and one of the containers was placed in box 1, containing only the fiberglass insulation while the second container was placed in the box 2, containing the fiberglass and polyethylene film combination. The air temperature outside of the boxes was observed to be 30° F. The water was allowed to cool in each of the boxes and the interior temperature of each box was recorded as a function of time. The following table summarizes the results of this EXAMPLE 1:

| TIME (MIN.) | INSIDE BOX TEMP. (F.°) Box 1 | Box 2 |
|---|---|---|
| 10 | 58 | 68 |
| 20 | 56 | 67 |
| 30 | 54 | 63 |
| 40 | 50 | 60 |
| 60 | 48 | 56 |
| 90 | 40 | 48 |

EXAMPLE 2:

This experiment was conducted using the attic of a home located in Shreveport, Louisiana, under various weather conditions. Upon inspection, the attic of the home was provided with nine inches of insulation located between the ceiling joists and resting on a sheetrock ceiling material secured to the bottom of the ceiling joists. The house was certified by Southwestern Electric Power Company for maximum energy efficiency. Temperature measurements in the attic when the attic air space temperature was 125° F. indicated that the temperature beneath the insulation and next to the sheetrock layer was 114° F., for an 11 degree temperature drop through the nine inch insulation layer. The temperature next to the sheetrock inside the house was 82° F., for a 32 degree temperature drop through the sheetrock, indicating that the insulation was providing very little insulating benefit.

A 2 mil film of polyethylene was installed between two of the ceiling joists and over the insulation between these ceiling joists in the attic of the house and the temperature was recorded at various points with a Doric Digital Trendicator furnished by the Department of Energy. At a point between the ceiling joists containing the film and beneath the insulation at the sheetrock layer the temperature was checked and was found to be 92° F., for a 33 degree drop through the insulation and a 10° drop through the sheetrock, indicating a marked increase (threefold) in the efficiency of the insulation when the film was installed. The following table summarizes the results of EXAMPLE 2:

| CHARACTER OF INSULATION | ΔT ACROSS INSULATION (F.°) | ATTIC AIR TEMP (F.°) | TEMP @ BOTTOM OF INSULATION ADJACENT CEILING (F.°) | ROOM TEMP. IN STRUCTURE ADJACENT CEILING |
|---|---|---|---|---|
| NO FILM | 15 | 40 | 55 | 70 |
| WITH FILM | 22 | 40 | 62 | 70 |
| NO FILM | 12 | 50 | 62 | 70 |
| WITH FILM | 18 | 50 | 68 | 70 |
| NO FILM | 11 | 125 | 114 | 82 |
| WITH FILM | 33 | 125 | 92 | 82 |

EXAMPLE 3:

Another home in Shreveport, La. was provided with a 2 mil sheet of polyethylene over the entire ceiling joist area which contained insulation located between the ceiling joists and resting on the sheetrock ceiling divider. This data was correlated, computed and indicated a 59% reduction in heating and cooling costs and a 35% reduction in total utility costs for the winter of 1981 and 1982. Additional study of data collected in this house in the summer of 1982 and winter of 1982–1983, indicates that the heating and cooling energy usage has been reduced by 50% to 75% due to the installation of the film.

EXAMPLE 4:

One of the questions raised during the experiments conducted with the polyethylene film is that of water collection beneath the film. In order to determine the nature and extent of any such water collection, a box 4 feet square on each side in the configuration of a cube was constructed and the top of the box was constructed similar to that of a home or commercial structure, with one-half inch sheetrock used as a ceiling material and fiberglass batts having a thickness of 8 inches installed over the sheetrock to simulate the attic area. A two mil sheeting of polyethylene was installed over one of the batts and a rack supporting two pans of water and an electric light bulb was placed inside the box. The box was then placed inside a cooler where the temperature was maintained at a temperature of 40° F. and numerous temperature measurements were made and recorded inside the box and at points where the insulation rested on the sheetrock ceiling material.

Initially, tests were conducted using a 300 watt heat lamp directed at the sheetrock inside the box. The temperature beneath the insulation and adjacent the sheetrock was found to be over 100° F. and moisture condensation was noted in both the insulation which was covered by the film and in the insulation which was not so covered. The heat lamp was replaced by a 100 watt light bulb, and the temperature inside the box was noted to be 60° F. A relative humidity reading of 70% was also noted. After approximately 48 hours, the moisture was observed to have evaporated and there was no evidence of condensation in either the insulation covered by the polyethylene film or the bare insulation. The 100 watt light bulb was then replaced by a 200 watt bulb, which raised the temperature inside the box to 74° F. and a relative humidity of 80% was noted. After 72 hours, moisture condensation was observed in the insulation with and without the film covering. This experiment was run several times and it was always observed that the condensation disappeared when the 100 watt light bulb was installed and after a forced dew point condition had been observed. In both cases, the moisture content was higher in the insulation which was not covered by a film than in the insulation covered by the film. It is believed that the air circulation in the insulation from the refrigeration unit in the cooler carried cold air into the insulation which was not covered by the film, thus creating a higher dew point condition.

While the preferred embodiments of the invention have been described above it will be recognized and understood that various modifications may be made therein and the appended claims are intended to cover all such modifications which may fall within the spirit and scope of the invention.

Having described my invention with the particularities set forth above, what is claimed is.

1. A ceiling insulation structure for an attic comprising ceiling joists disposed in spaced relationship in said attic to define parallel spaces; ceiling means secured to said ceiling joists and spanning said ceiling joists; insulation means resting on said ceiling means and disposed between said ceiling joists in said spaces; and flexible water vapor-permeable plastic film having a thickness in the range of from about 0.5 mills to about 12 mils covering said joists and said insulation, whereby said insulation is substantially isolated from air currents in said attic.

2. The ceiling insulation structure of claim 1 further comprising fastening means in cooperation with said film for securing said film to selected ones of said ceiling joists.

3. The ceiling insulation structure of claim 1 wherein said insulation means is particulate insulation loosely filling said spaces between said ceiling joists.

4. The ceiling insulation of claim 1 further comprising fastening means in cooperation with said film for securing said film to selected ones of said ceiling joists and wherein said insulation means is particulate insulation loosely filling said spaces between said ceiling joists.

5. The ceiling insulation structure of claim 1 wherein said insulation means is batts fitted in said spaces between said ceiling joists.

6. The ceiling insulation structure of claim 1 further comprising fastening means in cooperation with said film for securing said film to selected ones of said ceiling joists and wherein said insulation means is batts fitted in said spaces between said ceiling joists.

7. The ceiling insulation structure of claim 1 wherein said film means is polyethylene film having a thickness of from about 1.0 mils to about 6 mils and further comprising fastening means in cooperation with said polyethylene film for securing said film to selected ones of the ceiling joists.

8. In an attic of a structure having ceiling joists disposed in spaced relationship and a ceiling spanning the ceiling joists and isolating the attic and insulation resting on the ceiling in spaces between the ceiling joists, the improvement in combination therewith comprising flexible water vapor-permeable plastic film means having a thickness in the range of from about 1 mill to about 4 mills covering said ceiling joists and the insulation, whereby the insulation is substantially isolated from air currents in the attic.

9. The improvement of claim 8 further comprising fastening means in cooperation with said film means for securing said film to selected ones of the ceiling joists.

10. The improvement of claim 8 wherein the insulation is particulate insulation loosely filling the spaces between the ceiling joists.

11. The improvement of claim 8 further comprising fastening means in cooperation with said film means for securing said film means to selected ones of the ceiling joists and wherein the insulation is particulate insulation loosely filling the said spaces between the ceiling joists.

12. The improvement of claim 8 wherein the insulation is batts fitted in the spaces between the ceiling joists.

13. The improvement of claim 8 further comprising fastening means in cooperation with said film means for securing said film means to selected ones of the ceiling joists and wherein the insulation is batts fitted in the spaces between the ceiling joists.

* * * * *